US008078077B2

(12) United States Patent
Ohmura et al.

(10) Patent No.: US 8,078,077 B2
(45) Date of Patent: Dec. 13, 2011

(54) IMAGE FORMING APPARATUS WITH TWO COLORING MATERIAL SUPPLYING SECTIONS

(75) Inventors: Ken Ohmura, Tokyo (JP); Akihiro Nakamura, Tokyo (JP); Makoto Furuichi, Tokyo (JP); Hayato Konishi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1014 days.

(21) Appl. No.: 11/872,773

(22) Filed: Oct. 16, 2007

(65) Prior Publication Data

US 2008/0159770 A1 Jul. 3, 2008

(30) Foreign Application Priority Data

Dec. 6, 2006 (JP) ..... 2006-329183

(51) Int. Cl.
*G03G 15/00* (2006.01)

(52) U.S. Cl. ..... 399/82; 399/85

(58) Field of Classification Search ..... 399/82, 399/83, 85

See application file for complete search history.

(56) References Cited

U.S. PATENT DOCUMENTS 4,591,261 A * 5/1986 Saruwatari et al.
4,901,114 A * 2/1990 Parker et al.
5,493,386 A * 2/1996 Thompson
5,930,567 A * 7/1999 Agano
7,113,729 B2 * 9/2006 Toyohara ..... 399/82

FOREIGN PATENT DOCUMENTS

| | | |
|---|---|---|
| JP | 09-090701 | 4/1997 |
| JP | 11-143302 | 5/1999 |
| JP | 11334151 A * | 12/1999 |
| JP | 2000-172132 | 6/2000 |
| JP | 2005-246723 | 9/2005 |
| JP | 2005-345827 | 12/2005 |

OTHER PUBLICATIONS

Japanese Office Action mailing date Sep. 6, 2011 (4 pages) with English language translation thereof (4 pages).

* cited by examiner

*Primary Examiner* — David Gray
*Assistant Examiner* — Laura Roth
(74) *Attorney, Agent, or Firm* — Lucas & Mercanti, LLP

(57) ABSTRACT

Toners of the same color but with different characteristics are stored in the toner cartridges. For example, toners for high image quality (High Grade) with small particle diameter are stored in some toner cartridges and toners for low image quality (Low Grade) are stored in other toner cartridges. In this case, case, the mode of forming images using small particle diameter toner for high image quality using an image forming engine and the mode of forming images using a toner for low image quality using another image forming engine are executed by the image forming apparatus.

16 Claims, 10 Drawing Sheets

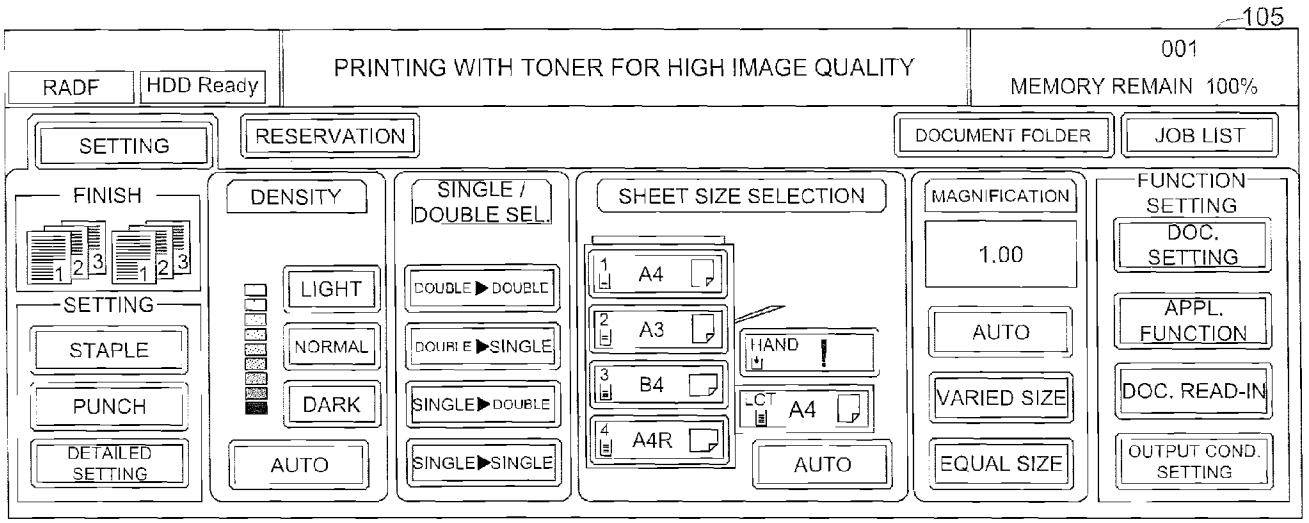
FIG. 8 ( a )
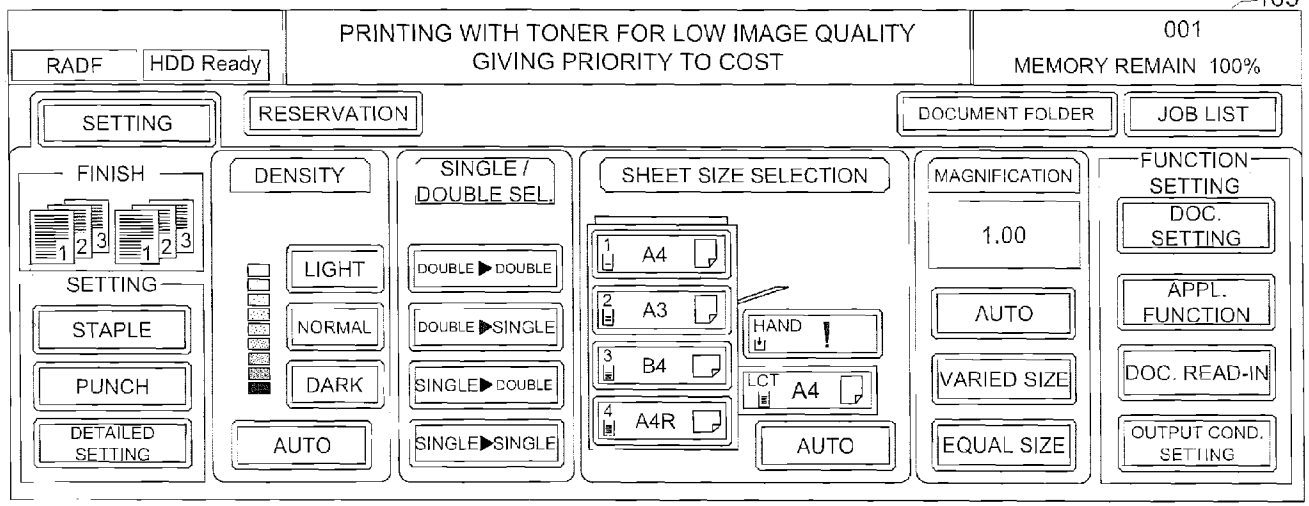
FIG. 8 ( b )

IMAGE FORMING APPARATUS WITH TWO COLORING MATERIAL SUPPLYING SECTIONS

This application is based on Japanese Patent Application No. 2006-329183 filed on Dec. 6, 2006, which is incorporated herein by reference.

BACKGROUND OF THE INVENTION

The present invention relates to image forming apparatuses that form images on sheet shaped image recording media.

Toners, inks, and heat transfer ribbons are available as the coloring materials for forming images on sheet shaped image recording media, and there are image forming apparatuses having various types of structures for forming images on sheets using these coloring materials. For example, regarding toners which are one type of coloring materials, there are various types of toners that differ from each other in their characteristics such as diameter or shape of particle, and image forming apparatuses have been proposed from the past that can form images on sheets even if different types of toners with different characteristics are used.

The technology disclosed in Patent Document 1 carries out image formation even when a genuine toner cartridge used and also when a non-genuine toner cartridge is used by changing the operating mode thereby preventing deterioration in image quality due to differences in the characteristics of the toner.

Further, the technology disclosed in Patent Document 2 is one in which a plurality of process cartridges are prepared that have toners of different characteristics such as particle diameter or toner manufacturing method, and the process cartridge that is installed in the image forming apparatus is made different depending on the purpose such as image quality, etc.

However, in the conventional technology, there is no image forming apparatus in which coloring materials of the same color but differing characteristics can be loaded at the same time, and when forming images using coloring materials with different characteristics is desired, it was cumbersome because it was necessary to replace with the cartridge containing the coloring material to be used. In other words, it was not possible to carry out image formation easily according to the user requirements related to the desired image quality or the cost of the coloring material, etc.

Patent Document 1: Japanese Unexamined Patent Application Publication No. 2005-326739

Patent Document 2: Japanese Unexamined Patent Application Publication No. 2000-172132

SUMMARY

Consequently, an object of the present invention is to provide a new and useful image forming apparatus in view of the foregoing. Specifically, it is to provide an image forming apparatus that easily realizes image formation according to the users' requirements related to the image quality or cost, etc.

In order to achieve the above object, the image forming apparatus according to the present invention is an image forming apparatus having a first supplying section in which a first container that stores a first coloring material for image formation can be detachably loaded, a second supplying section in which a second container that stores a second coloring material for image formation having the same color as but different characteristics from said first coloring material for image formation can be detachably loaded, and an image is formed on a sheet using said first coloring material or said second coloring material, with said image forming apparatus having the feature that it has a switching section that switches between a first image forming mode of forming images using said first coloring material and a second image forming mode of forming images using said second coloring material.

Further, an image forming apparatus according to the present invention is an image forming apparatus having a first supplying section that supplies a first coloring material for image formation, a second supplying section that supplies a second coloring material for image formation having the same color as but different characteristics from said first coloring material for image formation, and an image is formed, on a sheet using said first coloring material or said second coloring material, with said image forming apparatus having the feature that it has a switching section that switches between a first image forming mode of forming images using said first coloring material and a second image forming mode of forming images using said second coloring material.

Further, an image forming apparatus according to the present invention is an image forming apparatus having a first supplying section in which a first container that stores a first coloring material for image formation can be detachably loaded, a second supplying section in which a second container that stores a second coloring material for image formation having the same color as but different characteristics from said first coloring material for image formation can be detachably loaded, a first image forming section that carries out image formation using said first coloring material, a second image forming section that carries out image formation using said second coloring material, and a switching section that switches between a first image formation of forming images by said first image forming section using said first coloring material and a second image formation of forming images by said second image forming section using said second coloring material.

BRIEF DESCRIPTION OF THE DRAWINGS

FIGS. 8(*a*) and 8(*b*) are explanatory diagrams showing the display state in the operation and display section 105.

DETAILED DESCRIPTION OF THE PREFERRED EMBODIMENT

Figure 1:
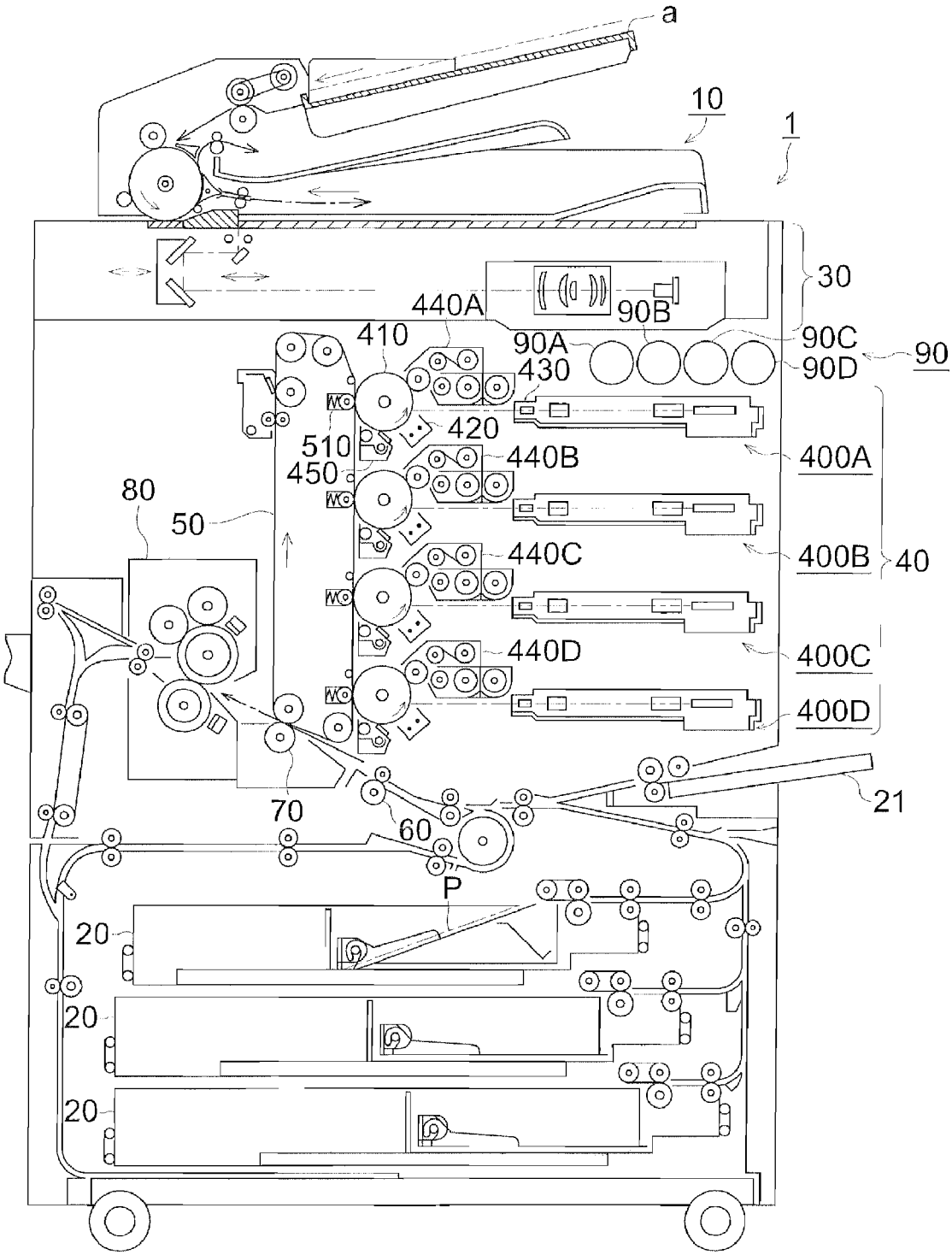
FIG. 1 is a middle cross-sectional diagram showing the internal configuration of an example of an image forming apparatus according to the present invention.

FIG. 1 is a middle cross-sectional diagram showing the internal configuration of an example of an image forming apparatus according to the present invention.

The image forming apparatus 1 is a tandem type image forming apparatus having an intermediate image transfer belt 50.

The document placed on the document feeder table "a" of the double sided document feeder device 10 is conveyed towards the image reading section 30 by various types of rollers.

The image forming apparatus 1 has in its lower part a plurality of sheet storage sections 20. Above the sheet storage section 20, the image forming section 40 and the intermediate image transfer belt 50 are placed, and the image reading section 30 is placed on the upper part of the main unit of the apparatus.

The sheet storage sections 20 can be drawn out toward the front side of the apparatus (toward the near side on FIG. 1). Standard papers such as white sheets are placed in the plurality of sheet storage sections 20 separating them into different sizes. Special sheets such as OHP sheets are set in the manual loading section 21.

The image forming section 40 has four sets of image forming engines 400A to 400D for forming toner images (any of the image forming engines 400A to 400D that form the visible images correspond to the first image forming section and the second image forming section). All the four sets of image forming engines 400A to 400D have the same type of configuration. The configuration is described taking the example of the image forming engine 400A that is positioned top most among the four sets of engines. The image forming engine 400A in the present preferred embodiment has a photoreceptor 410 that rotates in the anti-clockwise direction, a charger 420, an exposure section 430, and a developing unit 440A. The cleaning section 450 is placed so as to include the region opposite the lowermost part of the photoreceptor 410.

When forming a color image using the image forming apparatus 1, the four sets of image forming engines 400A to 400D operate so as to form toner images of the colors Y, M, C, and K from sequentially from the top. However, there are cases when it is sufficient to form monochrome images as per the user. Therefore, in the four sets of image forming engines 400A to 400D in the present preferred embodiment, toners that are coloring materials of the same color (for example, black toners) but with different characteristics are stored in each of the developing units, and monochrome images are formed by switching the image forming engine to be used. If images are formed by suitably switching the use of toners of the same color but with different characteristics, it is possible to form the image using a toner with a superior image quality, or to form the image using a toner that is advantageous in terms of cost, etc., thereby forming the image according to the desires of the users.

Here, concrete description is added about the characteristics of toners which are coloring materials, the toner characteristics can be roughly categorized into (1) development characteristics and (2) fixing characteristics.

Regarding (1) development characteristics, there are for example, (i) the "granularity" and (ii) the "charging characteristics and charge stability". The granularity is characteristics which is distribution of diameters of each toner particles. The granularity is directly related to image resolution. The "charging characteristics and charge stability" are directly related to image noise. If "charging characteristics and charge stability" are excellent, even if there is any change in the usage conditions such as the humidity or the printing mode, it is hard for changes in the density, background stain, or consumed quantity to appear.

On the other hand, the (2) fixing characteristics can be roughly divided into (i) fixing temperature and fixing strength characteristics, and (ii) glossiness characteristics. In the (i) fixing temperature and fixing strength characteristics, it is preferable that it has a broad tolerance towards special papers such as thick paper, Japanese "Washi" paper, coated paper, etc., and that it is possible to set the fixing temperature to a lower value as compared on the standard ordinary paper. Regarding the (ii) glossiness characteristics, although toners having high glossiness are preferable because it can give the third dimension and high quality looks to the photos, it also has a big relationship with the tastes of the users.

In addition, there is "color reproduction characteristics" as the characteristics of the coloring materials. There are the aging change in the image, that is, weather resistance (light resistance), and the range of reproduction of secondary colors due to overlapping of colors in "color reproduction characteristics".

In the case of inks for inkjets, there is "permeability characteristics" in addition to the above "color reproduction characteristics", and it is possible to suppress back imprinting, or to suppress enlargement of the dot diameter after the ink has landed.

The above natures of the coloring materials are called their characteristics. The coloring materials with those characteristics can be classified into at least "High Grade" and "Low Grade" whether the toner can fully or reasonably respond user's demands. "High Grade" and "Low Grade" may be classified by its performance relative to each other. Generally, the toner which can produce an excellent image even under various image forming conditions can be called as "High Grade", and the toner which can produce an excellent image under the image forming conditions fewer or narrower than those of the "High Grade" can be called as "Low Grade".

Returning to FIG. 1, in order to supply toner to each of the developing units in the four sets of image forming engines 400A to 400D, a toner supplying section 90 (coloring material replenishment section) is provided in the top part of the image forming apparatus 1. In the toner supplying section 90, a plurality of coloring material replenishment sections are provided so that cylindrical toner cartridges 90A to 90D can be removed and replaced, and the toners in the toner cartridges 90A to 90D are supplied to each of developing units via the toner supplying section 90. Although a description of the detailed structure is omitted here, the toner of the toner cartridge 90A is supplied to the developing unit 440A, and the toner of the toner cartridge 90B is supplied to the developing unit 440B. Further, the toner of the toner cartridge 90C is supplied to the developing unit 440C, and the toner of the toner cartridge 90D is supplied to the developing unit 440D. In the present preferred embodiment, toners of the same color but with different characteristics are stored in toner cartridges 90A to 90D, and detailed description is given later about this point.

The intermediate image transfer belt 50 located at the center of the image forming apparatus 1 has an endless shape, and has a prescribed volume resistivity. The primary transfer electrode 510 is provided at a position opposite to the photoreceptor 410 with the intermediate image transfer belt 50 coming in between them.

Next, the process of forming an image on a sheet P is described below.

The photoreceptor 410 is driven rotationally by a main motor (not shown in the figure), and is charged to negative polarity by the discharge from the charger 420 (for example, to −800 V). Next, an electrostatic latent image is formed by optical writing on the photoreceptor 410 according to the image information by the exposure section 430. When the formed electrostatic latent image passes through the developing unit 440A, the toner charged negatively inside the developing unit gets adhered to the part of the electrostatic latent image due to the application of a negative polarity development bias, and thus a toner image is formed on the photoreceptor 410. The formed toner image is transferred onto the intermediate image transfer belt 50 that is pressed in contact with the photoreceptor 410, and a toner image is formed on the intermediate image transfer belt 50. After the transfer, the toner remaining on the photoreceptor 410 is cleaned by the cleaning section 450.

One sheet of the sheet P at a time is discharged from the sheet storage section 20 and is conveyed up to the position of the registration roller 60. After the front edge of the sheet P is aligned by the registration roller 60, the sheet P is fed by the registration roller at a timing so as to match the toner image on the intermediate image transfer belt 50 in terms of the image position. The sheet P fed by the registration roller 60 is guided by guide plates and is sent to the transfer nipping section formed by the intermediate transfer belt 50 and the transfer section 70. The transfer section 70 constituted by a roller presses the sheet P against the intermediate image transfer belt 50. By applying a bias voltage (for example, +500 V) with a polarity opposite to that of the toner to the transfer section 70, because of the action of electrostatic force, the toner image on the intermediate image transfer belt 50 gets transferred onto the sheet P. The sheet P is separated from the intermediate image transfer belt 50 after being discharged by a separating apparatus (not shown in the figure) constituted by a discharging needle, and is conveyed to the fixing section so made up of a roller pair having a heated roller and a pressure roller. As a result, the toner image is fixed on the sheet P, and the sheet P with image formed on it is discharged to outside the apparatus.

Further, in the case in which the toner images of the colors Y, M, C, and K are formed by the four sets of image forming engines 400, the toner image of each color formed on each photoreceptor is transferred onto the intermediate image transfer belt 50 in a superimposing manner thereby forming a color image on the intermediate image transferred belt 50. Next, the color image on the intermediate image transfer belt 50 is transferred to the sheet P by the transfer section 70.

Figure 2:
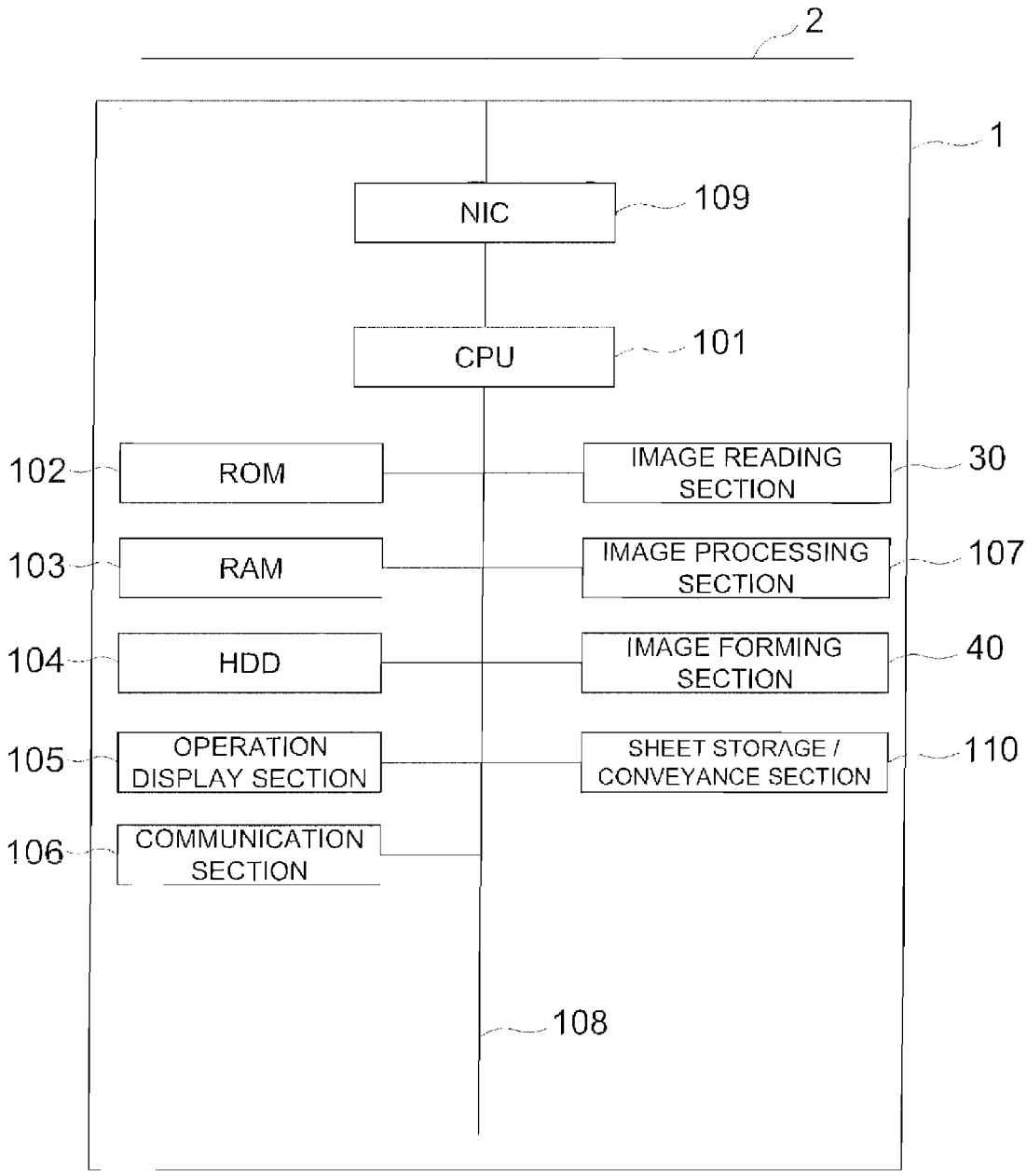
FIG. 2 is a block diagram of the control system of the image forming apparatus 1.

FIG. 2 is a block diagram of the control system of the image forming apparatus 1, and shows a typical control configuration.

The CPU 101 functioning as a switching section is one that controls the overall operation of the image forming apparatus 1, and is connected via the system bus 108 with a ROM (Read Only Memory) 102 and a RAM (Random Access Memory) 103, etc. This CPU 101 reads out the various control programs stored in the ROM 102 and expands them in the RAM 103, and controls the operation of each of the sections. Further, the CPU 101 executes the various processes according to the program expanded in the RAM 103, and not only stores the result of the processing in the RAM 103, but also displays it in the operation and display section 105. Next, the processing result stored in the RAM 103 is stored in the prescribed storage destination.

The network interface card (NIC) 109 is an interface between the system bus 108 and the network 2, and the image forming apparatus 1 is connected to the network 2 via the NIC 109.

The ROM 102 has programs, data and others, stored in advance in it, and this recording medium is constituted by a magnetic or optical recording medium, or by a semiconductor memory.

The RAM 103 constitutes a work area that temporarily stores the data processed by the various types of control programs executed by the CPU 101.

The HDD 104 has the function of storing the image data of the document image obtained by the image reading section 30, or of storing the image data that has already been output. This has a structure in which a plurality of metallic disks on which a magnetic material is coated or deposited by vacuum evaporation are placed at fixed intervals, and data is read out by rotating these disks at a high speed by a motor and bringing a magnetic head close to the disks.

The operation and display section 105 functioning as an operation section, a display section, and a registration section, makes it possible to make various types of settings. The operation and display section 105, for example, is of the touch panel type, and the contents of the print job are set by the user inputting by using this operation and display section 105. In addition, the information of network settings, and other different types of information are displayed in the operation and display section 105.

The communication section 10G is a communication interface carrying out data communication with other equipment, and is configured, for example, by a USB (Universal Serial Bus), IEEE 1284, IEEE 1394, PCMCIA and others.

The image reading section 30 optically reads the document image and converts it into electrical signals.

The image data generated by the image reading section 30 or the image data transmitted via the network 2 is subjected to image processing by the image processing section 107. In concrete terms, either the tone reproduction characteristics are corrected, or screen processing of node points is carried out by referring to the density correction LUT, or edge processing is done to enhance thin lines.

The image forming section 40 forms images on sheets based on the image data after image processing by the image processing section 107.

Next, the toners stored in the toner cartridges 90A to 90D are described below.

As was described regarding FIG. 1, a toner supplying section 90 is provided in the image forming apparatus 1, and in this toner supplying section 90, the toner cartridges 90A to 90D storing toners of the same color but having different characteristics are installed. For example, the color of the toners stored in each of the toner cartridges 90A to 90D can be black. It is also possible that the color is some other color as long as all the toners have the same color.

Further, the meaning of "same color" in the present invention is as follows.

Taking the example of black toner, in an L*a*b* color representation system, toners having an L* value of less than or equal to 24 with both a* and b* values in the range of 0 to |2.5| are called toners of the same color. The L*a*b* color representation system is a color representation system used for representing the color of objects and was standardized in 1976 by the International Illumination Committee (CIE), and is also adopted in Japan by JIS (Z8729). L* is the coordinate in the direction of the z axis and expresses the brightness, a* and b* are respectively the x axis and y axis coordinates and express the hue and chroma by the quantity difference H.

Further, the brightness is the relative brightness of the color, the hue is the tone of colors such as red, yellow, green, blue, violet, etc., and the chroma is the extent of vividness of the color.

Next, discussing colors other than black, when two toners are compared, two toners are said to be of the same color if the difference in the hue angles h of the respective toners is less than 30 degrees. The hue angle h, in an x-axis and y-axis plane expressing the relationship between the hue and the chroma when, for example, the brightness takes a certain value, is the angle subtended by the half line from the origin O to a certain coordinate point (a, b) and the straight line extending in the positive x axis direction (red direction) in the counterclockwise direction from the positive x axis direction (red direction), and is calculated using the following Equation (1).

$$\text{Hue angle } h = \tan-1(b^*/a^*) \quad (1)$$

In the x axis and y axis plane, negative direction of the x axis indicated by a* is the green direction, the positive direction of the y axis indicated by b* is the yellow direction, and the negative direction of that y axis is the blue direction.

The judgment of whether or not the color is the same is carried out based on the result of measurement of L*a*b* of the toner made into pellets by using a spectral photometer. In specific terms, L*a*b* is measured using the spectral photometer "Gretag Macbeth Specrtolino" (manufactured by Gretag Macbeth company).

The toner is made into pellets as follows.

Using a molding unit "BRIQUEUTTING MACHINE MP-35" (manufactured by Shimadzu corporation), the toner pellets are obtained by applying a load of 1,470,000N for 10 seconds at a molding temperature of 25° C. so that the pellet diameter becomes 35 mm, and pellet thickness becomes 3 mm (mass of toner is 3 to 4 g).

Further, the reflection spectrum of the toner pellets is measured using the above spectral photometer, taking a D65 as the light source, using a 4 mm diameter reflection measurement aperture, with the measurement wavelength range being from 380 nm to 730 nm at 10 nm intervals and with the sight angle (observer) being 2 degrees, and under conditions of using a special white tile for matching with the standards.

The description of the toners stored in the toner cartridges 90A to 90D is continued below.

Although the toners stored in the different toner cartridges 90A to 90D have the same color, their characteristics such as the diameter and shape of the particle are different.

For example, the toner cartridge 90A (the first container) stores small particle diameter toner for high image quality (High Grade) (the first coloring material), the toner cartridge 90B (the second container) stores cost priority toner of low image quality (Low Grade) (the second coloring material, and has a larger particle diameter than said small particle diameter toner). In this case, the mode of forming images by the image forming engine 400A (the first image forming section) using small particle diameter toner for high image quality (the first image forming mode), and the mode of forming images by the image forming engine 400B (the second image forming section) using the toner for low image quality (the second image forming mode) are executed by the image forming apparatus 1.

Further, as another example, a genuine toner (the first coloring material) manufactured by the manufacturer of the image forming apparatus 1 is stored in the toner cartridge 90C (the first container), and a non-genuine toner manufactured by a manufacturer other than the manufacturer of the image forming apparatus 1 (the second coloring material) is stored in the toner cartridge 90D (the second container). In this case, the mode of forming images by the image forming engine 400C (the first image forming section) using genuine toner (the first image forming mode), and the mode of forming images by the image forming engine 400D (the second image forming section) using the non-genuine toner (the second image forming mode) are executed by the image forming apparatus 1.

The four toners stored in each of the toner cartridges 90A to 90D can have different characteristics, or else, it is possible to change this to suit the user's desires so that two among the four cartridges have toners with the same characteristics, for example.

Since the characteristics of the toners stored in the toner cartridges 90A to 90D are different, in order to form images on sheets while selecting the toner to suit the purpose, it is necessary that the image forming apparatus recognizes which toner cartridge the toner of which characteristics is stored in. Although various methods can be thought of for making the image forming apparatus carry out this recognition, for example, it is possible to consider the method in which, at the time of installing the toner cartridge in the toner supplying section 90, the user inputs and registers the information such as the toner characteristics via the operation and display section 105. Further, as another method, an IC chip in which the information of the toner characteristics has been input is provided in the toner cartridge, this IC chip is read out by a sensor at the time the toner cartridge is installed in the toner supplying section 90 thereby detecting information such as the toner characteristics and also it is possible to detect the difference between the condition in which the toner cartridge and the image forming apparatus are engaged with each other. In addition, in the image forming apparatus, it is also possible to detect the physical characteristics of the toner itself.

Further, the recognized information is stored in a storage medium such as the RAM 102 and when image is to be formed on a sheet, any one of the image forming engines 400A to 400D is switched by the CPU 101 based on the information stored in the RAM 102.

Next, the operation of forming image on the sheet using a particular toner by switching the image forming mode based on the attributes of the print job or the contents of settings of the print job is described in detail below.

Firstly, the operation of switching the image forming mode based on the attributes of the print job is described below.

Figure 3:
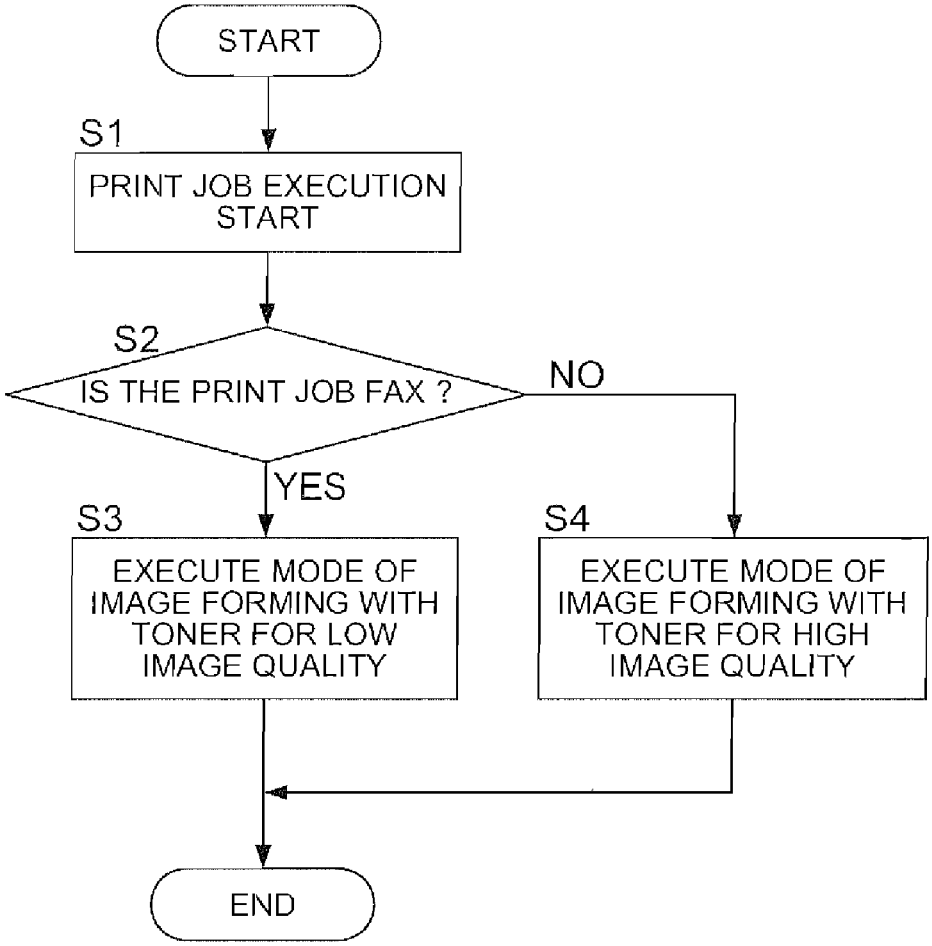
FIG. 3 is a flow chart describing the operation of switching the toner to be used based on the attributes of the print job.

FIG. 3 is a flow chart describing the operation of switching the image forming mode based on the attributes of the print job.

To start with, when the execution of the print job is started (Step S1), next a judgment is made as to what type of attributes are the print job attributes. For example, a judgment is made as to whether or not the attribute of the print job is fax as described in step S2. The operation in Step S2 is executed by the CPU 101 based on the data of the print job.

If the attribute of the print job is fax, it is judged that high image quality is not necessary for the image formed on the sheet, and the mode of forming images using the image forming engine in which a toner for low image quality is stored is executed (Step S3) so that the image is formed using a toner for low image quality giving priority to cost. On the other hand, it the attribute of the print job is not fax, that is, if the attribute of the print job is either Copy or Print, judging that it is necessary to output the image to be formed on the sheet with high image quality, and the mode of forming images using the image forming engine in which a toner for high image quality is stored is executed (Step S4) so that the image is formed using a toner for high image quality. The operation of switching the mode is executed by the CPU 101 by referring to the registered data establishing correlation between the type of toner and the attribute of the print job.

TABLE 1

| Job attribute information | Mode to be executed/ coloring material to be used |
|---|---|
| Copy | First mode/First coloring material |
| Print | First mode/First coloring material |
| Fax reception | Second mode/Second coloring material |
| Mailreception | Second mode/Second coloring material |
| JPEG | First mode/First coloring material |
| PDF | Second mode/Second coloring material |

As is shown in Table 1, the condition for each mode to be executed, and the mode to be executed or the toner to be used are stipulated in the registered data. As has been described above, correlation is established for the information of the mode to be executed or the information of the toner to be used according to the job attribute information such as whether the data that is the target of printing was obtained by copying or by fax reception. Apart from the examples listed above, it is also possible to establish correlation with parameters such as the file type (JPEG or PDF) of the data that is the target of printing, the file size of the data that is the target of printing, the image profile (color region) of the data that is the target of printing. Further, these contents are stored in a nonvolatile memory, and the stored contents can be changed at any time according to the user's desires via the operation and display section 105.

Further, as is shown in FIG. 3, the judgment of whether to carry out image formation using a toner for low image quality or to carry out image formation using a toner for high image quality is merely one example, it is also possible to carry out image formation after establishing correlation between toners of other characteristics and the attributes of the print job.

Next, the operation of switching the mode of image formation based on the content of the print job set using the operation and display section 105 is described here.

Figure 4:
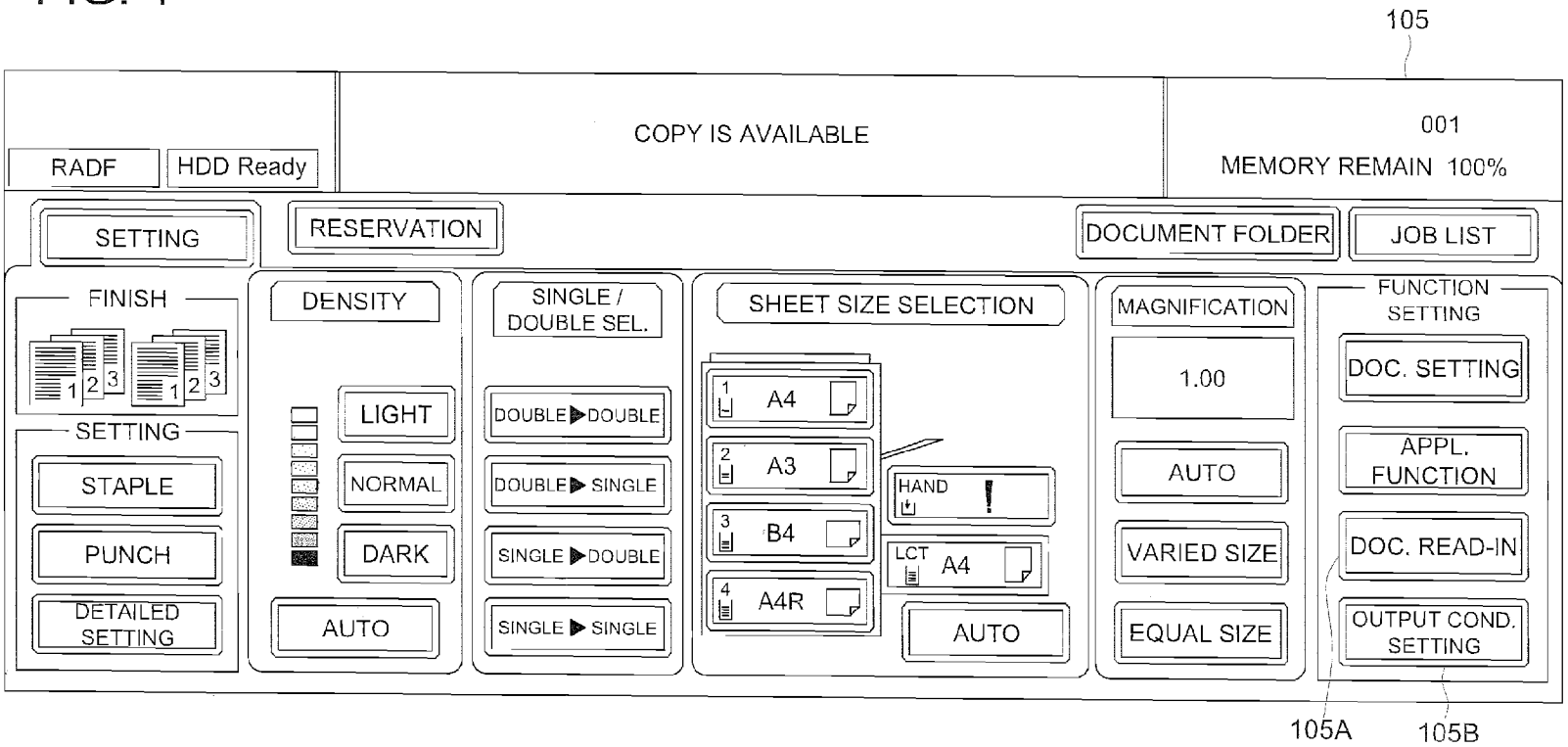
FIG. 4 is an explanatory diagram showing the basic screen of the operation and display section 105.

FIG. 4 is an explanatory diagram showing the basic screen of the operation and display section 105.

The screen shown in FIG. 4 is the basic screen of the operation and display section 105, and it is possible to make various settings such as the density, selection of single-sided or double-sided printing, sheet size selection and others. The content of the print job is set via the basic screen shown in FIG. 4. Firstly, among the set contents of the print job, the operation of switching the mode of image formation based on the contents of settings related to document read-out is described here.

Figure 5:
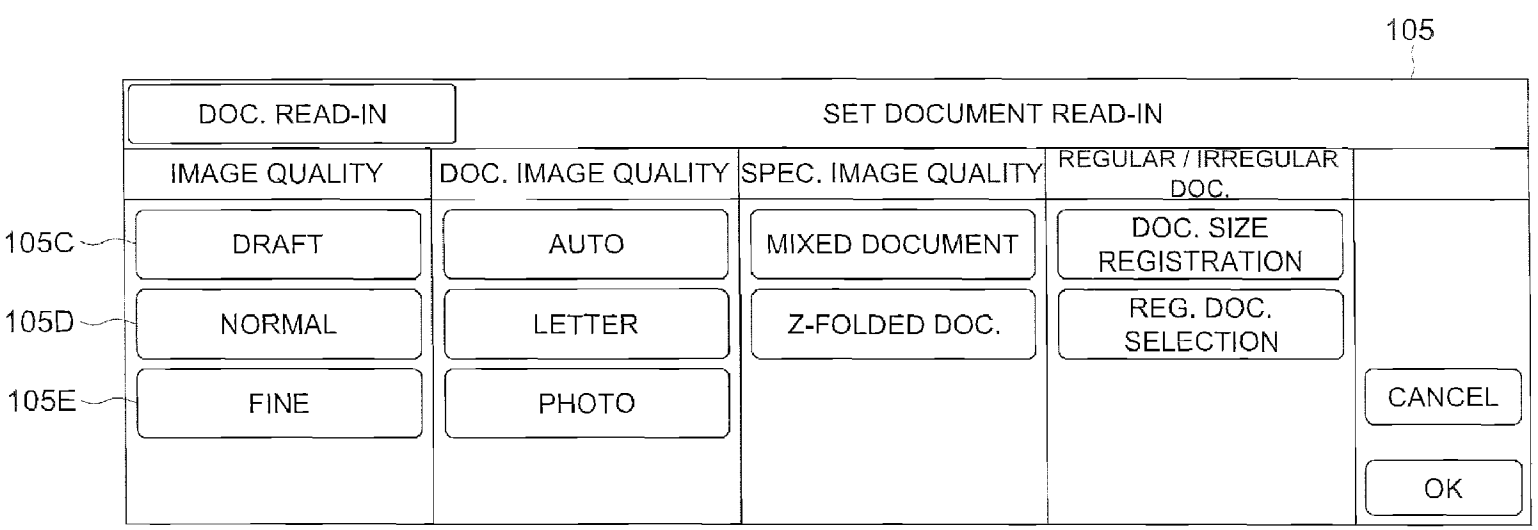
FIG. 5 is an explanatory diagram related to the setting screen of document read out in the operation and display section 105.

When the document read button 105A on the right side of the basic screen in FIG. 4 is pressed, a screen for carrying out settings for document read is displayed as is shown in FIG. 5. In the screen shown in FIG. 5, there is a setting item called "Image quality", and in this setting item it is possible to make the three types of settings of "Draft", "Normal", and "Fine". When the user outputs the image by selecting "Draft", it is very often that output is a test print, and it is considered that the user does not require output with a high image quality. On the other hand, when the user outputs the image by selecting either "Normal" or "Fine", it is considered that the user is requesting the output to be made with a high image quality.

Therefore, the case in which the content related to the image quality of the print job is set by pressing the Draft button 105C and the case in which the content related to the image quality of the print job is set by pressing the Normal button 105D or the Fine button 105E are distinguished, the toners used in these print jobs are made different, and the image forming mode switching is executed. For example, when the Draft button 105C is pressed, the mode of forming images using the image forming engine in which a toner for low image quality is stored is executed so that the image is formed using a toner for low image quality giving priority to cost. Further, when the Normal button 105D or the Fine button 105E is pressed, the mode of forming images using the image forming engine in which a toner of a small particle diameter for high image quality is stored is executed so that the image is formed using a toner of a small particle diameter for high image quality.

Further, in the preferred embodiment described above, although an example was given of setting the contents related to image quality at the time of reading the document as the job setting information, the present invention is not construed to be limited to this. It is also possible to make the desired setting between Fine and Draft using an image recording mode setting button not shown in the operation and display section 105, or else it is also possible to make a setting of the recording density such as 1200 dpi or 400 dpi, or others (where dpi is the number of pixels in one inch (2.54 cm). In addition, in the case of a print job, it goes without saying that the image recording mode can be set in the printer driver provided in the computer connected to the image forming apparatus, and the switching is made based on the contents of the setting made. An example of the registered data establishing correlation between the job setting information and the information of the mode to be executed or the information of the toner to be used is shown in Table 2.

TABLE 2

| Job setting information | Mode to be executed/ coloring material to be used |
|---|---|
| Document read image quality: Fine | First mode/First coloring material |
| Document read image quality: Draft | Second mode/Second coloring material |
| Document recording image quality: Fine | First mode/First coloring material |
| Document recording image quality: Draft | Second mode/Second coloring material |
| Document recording density: 1200 dpi | First mode/First coloring material |
| Document recording density: 400 dpi | Second mode/Second coloring material |

Next, the operation of switching the image forming mode based on the contents of setting related to the output conditions among the contents of settings of print jobs is described below.

Figure 6:
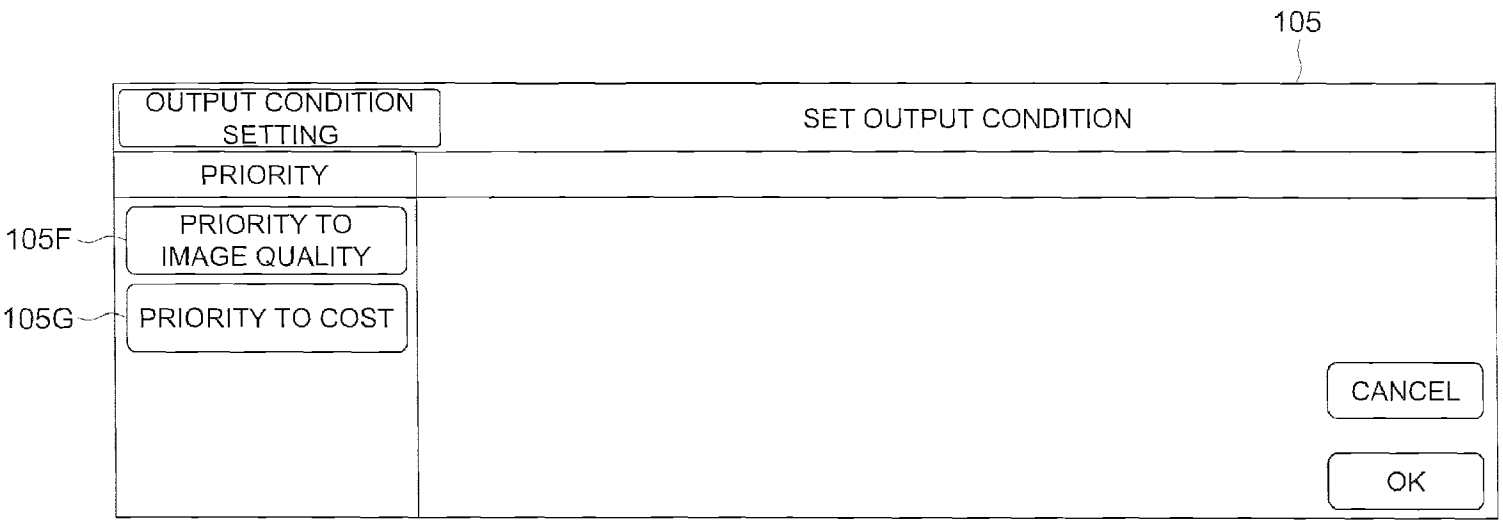
FIG. 6 is an explanatory diagram related to the setting screen of the output conditions in the operation and display section 105.

When the output conditions setting button 105B on the right side of the basic screen in FIG. 4 is pressed, the screen for making settings of the output conditions is displayed as shown in FIG. 6. There is a setting item called "Priority" in the screen shown in FIG. 6, and it is possible to make the two types of settings of "Image quality priority" or "Cost priority" in this setting item. These correspond to the user's requirement that the output has to be made giving priority to image quality even if the cost is higher, and that the output has to be made giving priority to the cost even if the image quality is slightly bad.

Therefore, the case in which the content of the print job is set by pressing the Image quality priority button 105F and the case in which the content of the print job is set by pressing the Cost priority button 105G are distinguished, the toners used in these print jobs are made different, and the image forming mode switching is executed. For example, when the Image quality priority button 105F is pressed, the mode of forming images using the image forming engine in which a small particle diameter toner for high image quality is stored is executed so that the image is formed using a small particle diameter toner for high image quality. Further, when the Cost priority button 105G is pressed, the mode of forming images using the image forming engine in which a toner for low image quality is stored is executed so that the image is formed using a toner for low image quality giving priority to cost.

Further, it is possible to consider setting items other than the setting item "Priority" as the operation of switching the mode of image formation depending on the content of settings related to the output conditions.

Figure 7:
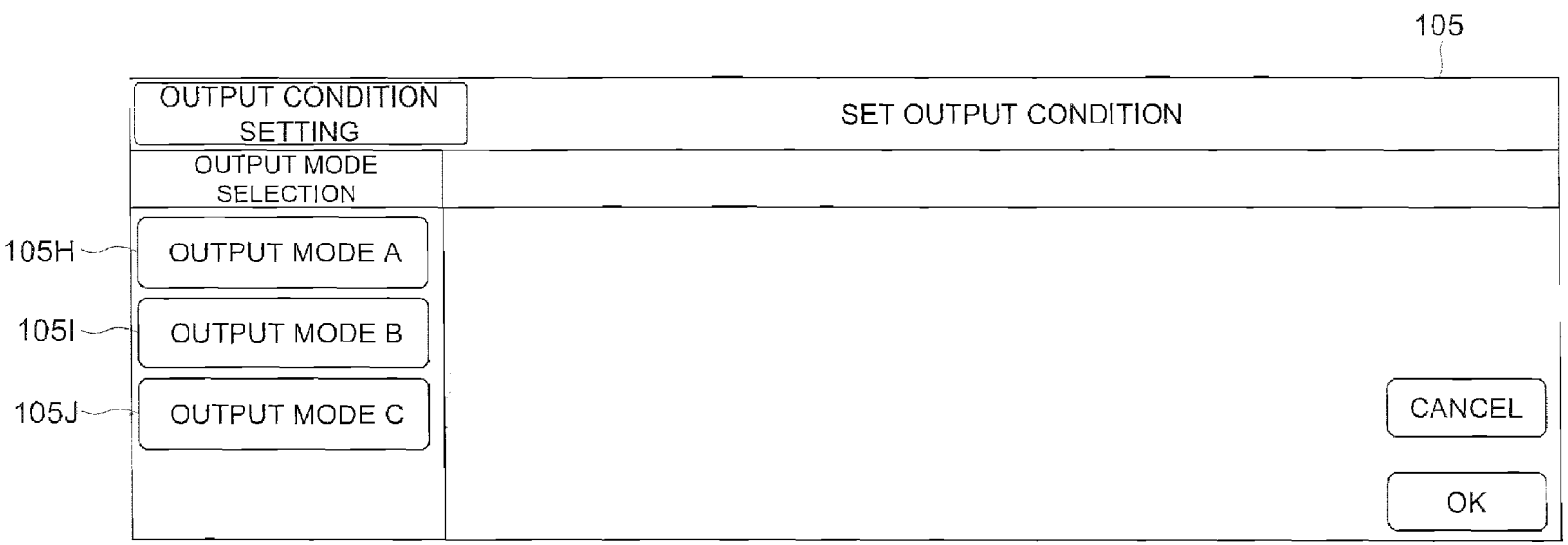
FIG. 7 is an explanatory diagram related to the setting screen of the output conditions in the operation and display section 105.

For example, if the output conditions setting button 105B is pressed in the basic screen of FIG. 4, it is possible to make the screen shown in FIG. 7 to be displayed instead of the screen shown in FIG. 6.

In the screen shown in FIG. 7, there is a setting item called "Output mode selection", and in this setting item it is possible to make the three types of settings of "Output mode A" (button 105H), "Output mode B" (button 105I), and "Output mode C" (button 105J).

The user registers in advance the toner to be used for the each of the output modes. For example, registration is made so that image formation is made using the genuine toner in the Output mode A, and registration is made so that image formation is made using a non-genuine toner in the Output mode B. Further, it is also possible to configure so that the operation of switching the image forming mode is executed so that the toner used during image formation is switched based on the content of the print job set in the setting item of "Output mode selection".

Further, in the above preferred embodiment, although examples were given in which the user set "Image quality priority", "Cost priority" as the user selecting information, or selects the desired one among the "Output mode selections" that have been registered in advance, the present invention is not restricted to these. It is also possible to configure so that the user selects directly the toner to be used.

Further, even the mode switching operation based on the contents of setting of the print job is executed by the CPU 101 while referring to the registered data in which correlation is established between the type of toner and the content of setting of the print job. The registered data stipulates the conditions for executing the respective modes, and can be edited at any time as desired by the user via the operation and display section 105.

Although examples of setting items were given in FIG. 5 to FIG. 7, they are not limited to these. For example, it is possible to configure so that the toner used is switched depending on the content of setting of the type of sheet P such as "Thick paper", "Thin papers" or so that the toner used is switched depending on the content of setting of the power saving mode of the image forming apparatus such as "Power save", "Normal".

In addition, although in the above examples, correlation was established between items such as attributes of the print job, job setting information, user selecting information and the toner to be used or the image forming mode to be executed and these correlations were stored, it is also possible to establish correlation between items such as attributes of the print job, job setting information, user selecting information and the image forming section or the toner supplying section to be used and to store these correlations.

As has been described regarding FIG. 3 to FIG. 7 above, if the coloring material is switched such as the toner to be used depending on the contents of settings of the print job attributes or print job settings, it is possible to from images by using a coloring material that suits the user's requirements such as image quality or cost.

The following can be considered as the operation of the image forming apparatus 1 when image is formed by switching the coloring material such as the toner used for image formation.

Although toners for high image quality and toner for cost priority low image quality were described above as the types of toners with different characteristics, it is also possible to change the conditions of image formation when using toners by switching the image forming mode. For example, when forming images using a toner for high image quality, the image is formed on the sheet under conditions for high image quality such as carrying out image formation with a high recording density (for example, at 1200 dpi), or carrying out image processing using screen processing. On the other hand, when forming images using a cost priority low image quality toner, the image is formed on the sheet under conditions for low image quality such as carrying out image formation with a low recording density (for example, at 400 dpi). Further, as another example, it is possible to change the process conditions such as fixing conditions (amount of heat, etc.) or the development conditions (surface potential of the photoreceptor, value of development bias, etc.) in the case of forming images using a toner for high image quality as opposed to the case of forming images using a toner for low image quality.

Further, when carrying out image formation switching the mode of image formation, it is possible to think of situations in which the image is formed using a toner that does not match with the requirements of the user. In view of this, it is possible to display in the operation and display section 105, before starting image formation, a message such as "Printing using genuine toner. Is it OK?" Thereafter, unless the user sees the message and presses the Start button, the image formation will not be started. Because of this, it is possible to prevent the image formation being made using a toner that is different from that desired by the user.

Further, it is also possible to change the display mode in the operation and display section 105 when the image is being formed. For example, when forming images using a toner for high image quality, a message such as "Printing using high image quality toner" (the first display mode) as is shown in FIG. 8(*a*) in the operation and display section 105, and when forming images using cost priority low image quality toner, a message such as "Printing using cost priority low image quality toner" (the second display mode) as is shown in FIG. 8(*b*) in the operation and display section 105. Because of this, it is possible for the user to know easily with what toner the image is being formed.

In addition, when the toner is exhausted in the toner cartridges 90A to 90D installed in the toner supplying section 90, it is also possible to consider informing the user about a toner cartridge with what kind of toner filled in it to install next. It is also possible to monitor that toner with what characteristics is being used frequently for image formation until the toner is exhausted, using prescribed program, and to display a message in the operation and display section 105 prompting to install a toner cartridge having the toner that is being used most frequently.

Further, when the first toner (coloring material) or the second toner (coloring material) is exhausted, image formation using the exhausted toner is prohibited, or else, it is also possible to make it not possible to select the image forming mode corresponding to the exhausted toner. On the other hand, for the print job that is currently being executed or the print job that is scheduled to be executed by the image formation or image forming mode using the exhausted toner, it is also possible to substitute using image formation or image forming mode using a still remaining toner with the same color but with different characteristics. At this time, this substituting can be made automatically, or can be substituted after first displaying a message of substituting and proceeding based on approval by the user.

Further, when the image forming apparatus cannot recognize that toner with which characteristics is being stored in which cartridge, it is also possible to carry out image formation or image forming mode using the toner that can be recognized. It this recognition cannot be made for all the toners or toner cartridges, it is also possible to carry out image formation or image forming mode based on a predetermined rule (for example, using the first image forming section or using the toner supplied by the first toner supplying section, etc.). At this time, even regarding the image formation conditions, it is possible to carry out image formation with prescribed conditions such as conditions when being shipped from the factory, or else to let the user select the conditions. In addition, it is also possible to manage the history information of image formation conditions and to select automatically the most frequently used conditions based on that history information.

Further, the present invention is not limited to the preferred embodiments, and any modifications or additions within the scope and intent of the present invention shall be included in the present invention.

Figure 9:
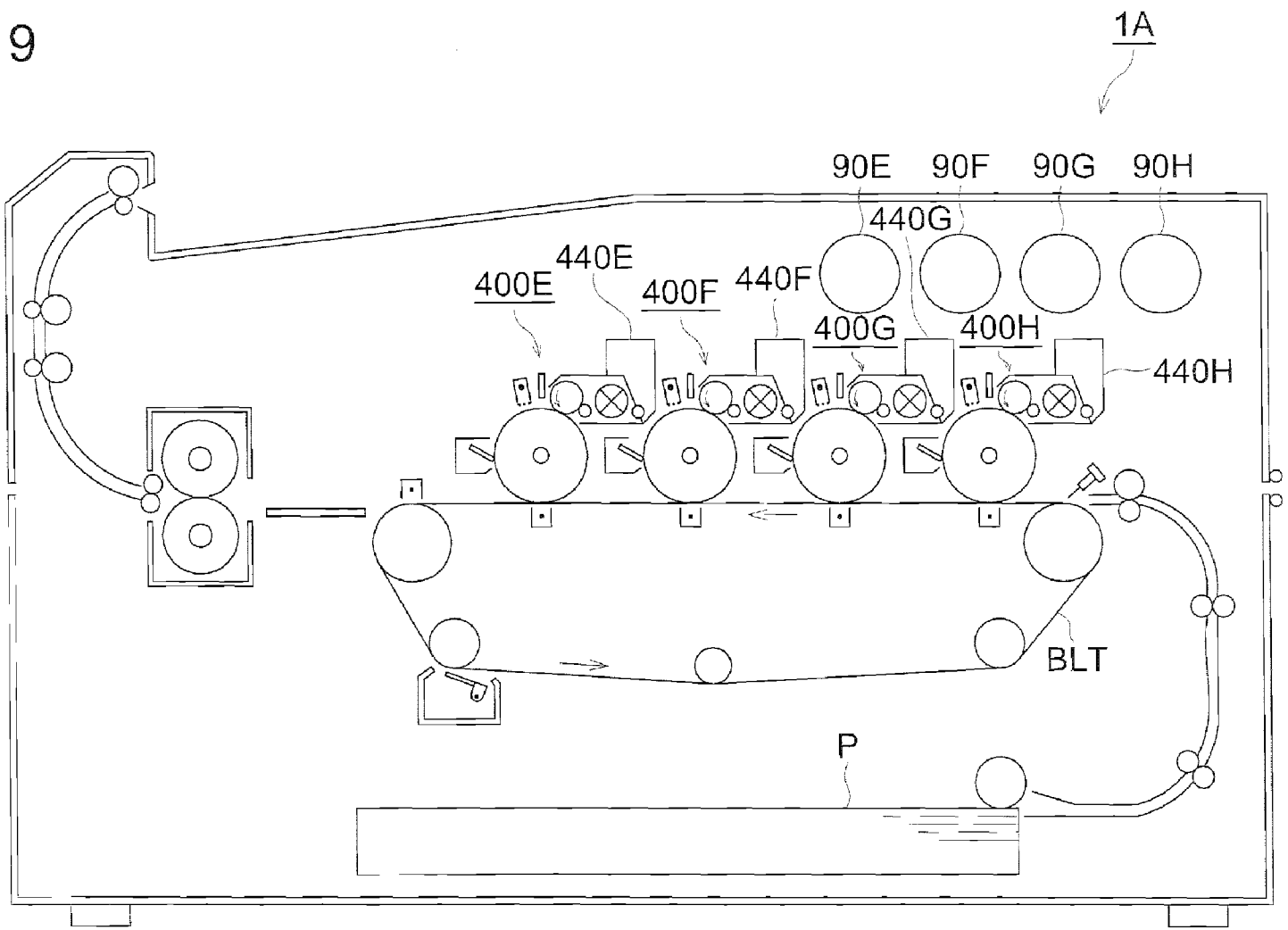
FIG. 9 is a middle cross-sectional diagram showing the internal configuration of an example of an image forming apparatus 1A which is another preferred embodiment.

Although the above explanations were made using a tandem type image forming apparatus shown in FIG. 1 as the image forming apparatus, it is also possible, for example, to use a tandem type image forming apparatus 1A shown in FIG. 9 that does not use an intermediate image transfer belt and directly transfers the image onto the sheet P. The image forming apparatus 1A shown in FIG. 9 has four sets of image forming engines 400E to 400H installed in it, and the toner images formed in, each of the image forming engines are transferred directly onto the sheet P that is conveyed by the transfer belt BLT. Toners of the same color but with different characteristics are stored in the toner cartridges 90E to 90H and are being supplied to each of the developing units 440E to 440H of the respective image forming engines 400E to 400H.

Figure 10:
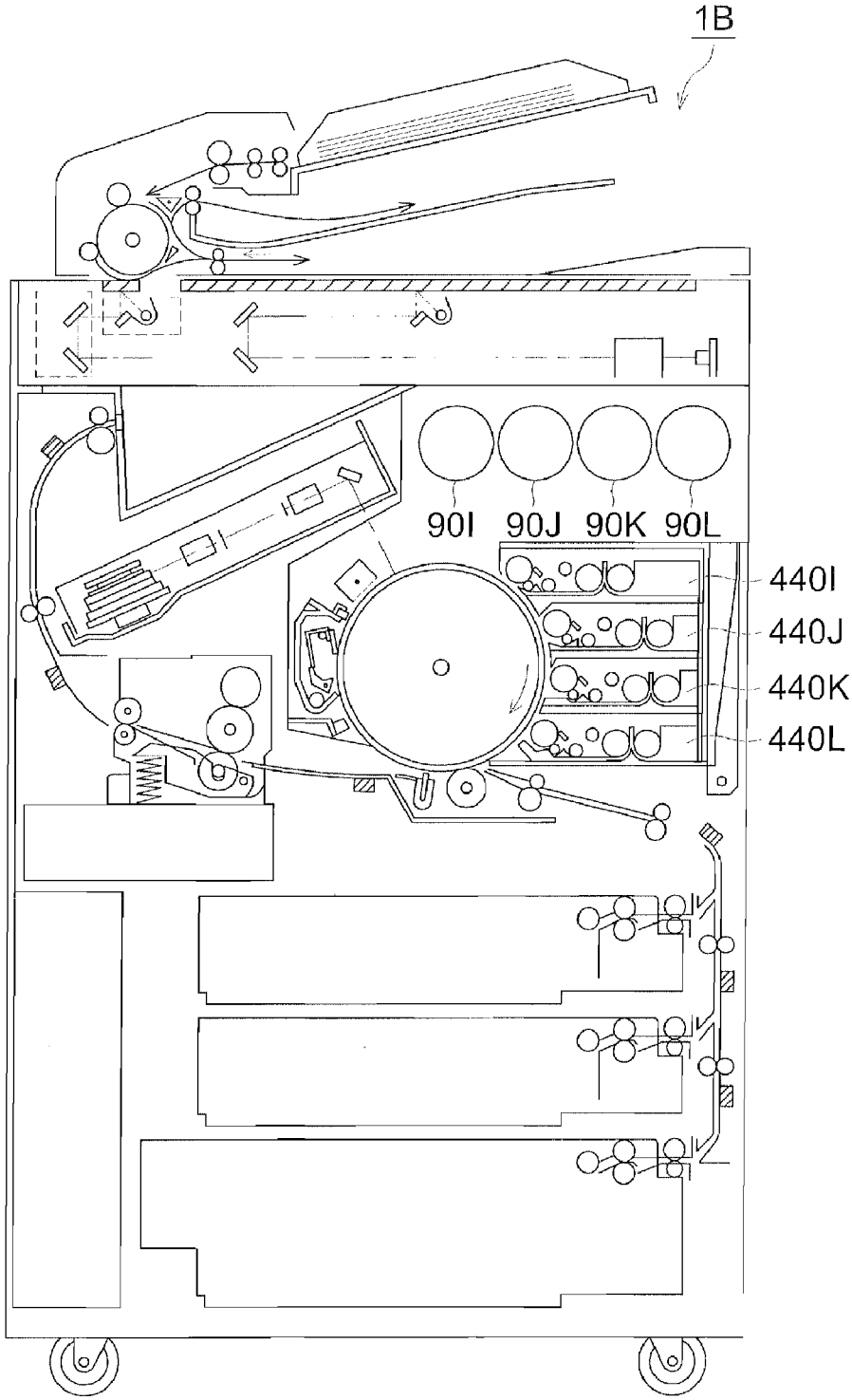
FIG. 10 is a middle cross-sectional diagram showing the internal configuration of an example of an image forming apparatus 1B which is another preferred embodiment.

Further, as is shown in FIG. 10, it can also be an image forming apparatus 1B in which the plurality of developing units 440I to 440L are provided around the periphery of a single photoreceptor. (In the image forming apparatus 1B shown in FIG. 10, each developing unit corresponds to the first image forming section and the second image forming section.) Toners of the same color but with different characteristics are stored in the toner cartridges 90I to 90L and those toners are supplied to the different developing units 440I to 440L.

Although in the above preferred embodiment an example was shown of an image forming apparatus in which four toner cartridges are installed in a removable manner, the present invention is not limited to this. In other words, it is sufficient if the image forming apparatus has a first supplying section in which a first container storing a first coloring material for image formation is detachably installed, and a second supplying section in which a second container storing a second coloring material for image formation is detachably installed, with at least two of them being detachably installed. In addition, in a form in which there is no container storing the coloring materials, it is sufficient if only the first and the second supplying sections supplying the first and the second coloring materials are provided.

In addition, although explanation was given in the present preferred embodiment using toners as the coloring materials, similar effect can also be obtained even if it is an image forming apparatus that forms images using other coloring materials such as inks or thermal transfer ribbons, or others.

According to the image forming apparatus of the present invention, it is possible to form images using coloring materials selected reflecting the user's desires related to image quality, cost, and others.

What is claimed is:

1. An image forming apparatus for forming an image on a sheet by using a first coloring material for image formation or a second coloring material for image formation having a same color as a color of the first coloring material and a different characteristic from a characteristic of the first coloring material, the image forming apparatus comprising:

a first supplying section to supply the first coloring material;

a second supplying section to supply the second coloring material;

a switching section to switch between a first image forming mode for forming an image by using the first coloring material and a second image forming mode for forming an image by using the second coloring material; and a storing device to store registration data in which correlation between an attribute of a print job and an image forming mode to be executed is established, wherein the switching section conducts a mode switching operation based on the attribute of a print job; and wherein the attribute of a print job is at least one of copying, printing, fax reception, mail reception, a type of a data file and a size of a data file.

2. The image forming apparatus of claim further comprising:

a first container to store the first coloring material; and a second container to store the second coloring material, wherein the first container and the second container are detachably loaded on the first supplying section and the second supplying section, respectively.

3. The image forming apparatus of claim 1 further comprising:

a first image forming section to form an image by using the first coloring material, and a second image forming section to form an image by using the second coloring material, wherein an image is formed by using the first image forming section in the first image forming mode and an image is formed by using the second image forming section in the second image forming mode.

4. The image forming apparatus of claim 1 further comprising, a storing section to store registration data in which correlation between the attribute of a print job and a coloring material to be used is established.

5. The image forming apparatus of claim 1, wherein the switching section conducts a mode switching operation based on job setting information set for a print job.

6. The image forming apparatus of claim 5 further comprising, a storing device to store registration data in which correlation between the job setting information and an image forming mode to be executed is established.

7. The image forming apparatus of claim 5 further comprising, an operating section to set the job setting information.

8. The image forming apparatus of claim 5, wherein the job setting information is at least one of document reading image quality, image recording image quality and image recording density.

9. The image forming apparatus of claim 5 further comprising, a storing section to store registration data in which correlation between the job setting information and a coloring material to be used is established.

10. The image forming apparatus of claim 1, wherein the switching section conducts a mode switching operation based on user selecting information set for a print job.

11. The image forming apparatus of claim 10 further comprising, a storing device to store registration data in which correlation between the user selecting information and an image forming mode to be executed is established.

12. The image forming apparatus of claim 10 further comprising, an operating section to set the user selecting information.

13. The image forming apparatus of claim 10, wherein the user selecting information is at least one of information about giving priority to image quality, information about giving priority to cost, information designating a coloring material for image formation.

14. The image forming apparatus of claim 10 further comprising, a storing section to store registration data in which correlation between the user selecting information and a coloring material to be used is established.

15. The image forming apparatus of claim 1, wherein an image forming condition in the first image forming mode is different from an image forming condition in the second image forming mode.

16. The image forming apparatus of claim 1 further comprising, a display section to display a first display form when the first image forming mode is in execution and a second display form when the second image forming mode is in execution.

* * * * *